US010302305B2

(12) United States Patent
Jeong et al.

(10) Patent No.: US 10,302,305 B2
(45) Date of Patent: May 28, 2019

(54) BURNER FOR GAS COOKER

(71) Applicant: LG ELECTRONICS INC., Seoul (KR)

(72) Inventors: Jeonghoon Jeong, Seoul (KR); Jongryul Kim, Seoul (KR); Seungyoun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 263 days.

(21) Appl. No.: 15/255,497

(22) Filed: Sep. 2, 2016

(65) Prior Publication Data

US 2017/0067645 A1 Mar. 9, 2017

(30) Foreign Application Priority Data

Sep. 3, 2015 (KR) ..... 10-2015-0125170

(51) Int. Cl.
*F24C 3/00* (2006.01)
*F24C 3/08* (2006.01)
(Continued)

(52) U.S. Cl.
CPC ..... *F24C 3/085* (2013.01); *F23D 14/04* (2013.01); *F23D 14/125* (2013.01); *F23D 14/22* (2013.01); *F24C 3/103* (2013.01); *F24C 15/001* (2013.01); *F24C 15/10* (2013.01); *F23D 2203/00* (2013.01); *F23D 2203/002* (2013.01)

(58) Field of Classification Search
CPC .... F24C 15/101; F24C 15/001; F24C 15/108; F24C 3/08; F24C 3/103
USPC ..... 126/39 K, 29 H, 39 N, 39 J, 39 R; 431/326, 328, 329
See application file for complete search history.

(56) References Cited

U.S. PATENT DOCUMENTS 2,194,208 A * 3/1940 Moran ..... F23C 99/00 431/328
3,852,025 A * 12/1974 Placek ..... F23D 14/145 126/92 B
(Continued)

FOREIGN PATENT DOCUMENTS

DE 19605649 8/1997
GB 2316479 2/1998
(Continued)

OTHER PUBLICATIONS

International Search Report in International Application No. PCT/KR2016/009736, dated Dec. 27, 2016, 3 pages (with English translation).
(Continued)

*Primary Examiner* — Vivek K Shirsat
(74) *Attorney, Agent, or Firm* — Fish & Richardson P.C.

(57) ABSTRACT

A burner for a gas cooker that includes a burner port defining an interior area, the burner port including an opening to the interior area; one or more tubes that are coupled to the burner port and that are configured to provide mixed gas to the interior area of the burner port; a heating element that is configured to cover the opening of the burner port and that is heated by gas-generated heat; and a shielding plate that (i) is coupled between the heating element and the burner port, (ii) is configured to cover a first portion of the opening of the burner port, and (iii) is configured to spread mixed gas that is provided from the one or more tubes into the interior area of the burner port.

20 Claims, 18 Drawing Sheets

(51) Int. Cl.

| | |
|---|---|
| ***F23D 14/22*** | (2006.01) |
| ***F24C 3/10*** | (2006.01) |
| ***F24C 15/00*** | (2006.01) |
| ***F24C 15/10*** | (2006.01) |
| ***F23D 14/04*** | (2006.01) |
| ***F23D 14/12*** | (2006.01) |

(56) References Cited

U.S. PATENT DOCUMENTS

| | | | | |
|---|---|---|---|---|
| 5,509,403 | A * | 4/1996 | Kahlke | F24C 3/067 126/39 E |
| 2015/0184864 | A1 | 7/2015 | Kim et al. | |

FOREIGN PATENT DOCUMENTS

| | | |
|---|---|---|
| JP | H07-280219 | 10/1995 |
| KR | 10-2002-0056337 | 7/2002 |
| KR | 10-2003-0076248 | 9/2003 |
| KR | 10-2005-0097716 | 10/2005 |
| KR | 10-2011-0050828 | 6/2011 |
| KR | 10-2012-0020774 | 3/2012 |

OTHER PUBLICATIONS

Korean Notice of Allowance in Korean Application No. 20140052069, dated Feb. 17, 2017, 2 pages.
European Search Report in European Appin. No. 16842293.9, dated Feb. 22, 2019, 7 pages.

* cited by examiner

BURNER FOR GAS COOKER

CROSS-REFERENCE TO RELATED APPLICATION

The application claims priority under 35 U.S.C. § 119 and 35 U.S.C. § 365 to Korean Patent Application No. 10-2015-0125170 filed on Sep. 3, 2015 whose entire disclosure is hereby incorporated by reference.

TECHNICAL FIELD

The present disclosure generally relates to a burner for a gas cooker.

BACKGROUND

A gas cooker is a home appliance that cooks food using heat. To provide heat, the gas cooker includes a burner. The burner may use gas to generate heat.

The gas cooker is classified into an open-flame type in which a burner is exposed to an outside of a product, and flame directly heats food or heats a container in which the food is put, and a radiant type in which the burner is provided inside the product, and a radiator is heated using combustion heat, and the food or the container in which the food is put is heated using a radiant wave emitted from the heated radiator to an outside.

SUMMARY

The present disclosure is related to a burner for a gas cooker that enables gas supplied into a burner port to be evenly supplied to a heating element.

In general, one innovative aspect of the subject matter described in this specification can be embodied in burner for a gas cooker comprising a burner port defining an interior area, the burner port including an opening to the interior area; one or more tubes that are coupled to the burner port and that are configured to provide mixed gas to the interior area of the burner port; a heating element that is configured to cover the opening of the burner port and that is heated by gas-generated heat; and a shielding plate that (i) is coupled between the heating element and the burner port, (ii) is configured to cover a first portion of the opening of the burner port, and (iii) is configured to spread mixed gas that is provided from the one or more tubes into the interior area of the burner port, wherein the first portion of the opening is oriented toward one or more coupling portions that couple the burner port to the one or more tubes.

The foregoing and other embodiments can each optionally include one or more of the following features, alone or in combination. In particular, one embodiment includes all the following features in combination. The burner further comprises a plurality of ribs that are configured to guide mixed gas flow provided from the one or more tubes and that are located in the interior area of the burner port. The shielding plate includes a plurality of holes, wherein mixed gas is configured to pass through the plurality of holes. The interior area of the burner port includes a central area and a peripheral area surrounding the central area, wherein the plurality of holes are more densely distributed in the central area than in the peripheral area. The interior area of the burner port includes a central area and a peripheral area surrounding the central area, wherein the plurality of holes on the shielding plate are radially distributed in the central area. The shielding plate includes a first portion that is coupled to the burner port and a second portion that is not coupled to the burner port. The shielding plate is coupled to the plurality of ribs. A first tube of the one or more tubes is coupled to first ribs of the plurality of ribs, the first ribs guiding mixed gas flow that is provided from the first tube. Second ribs of the plurality of ribs are not coupled to the first tube and are configured to change mixed gas flow that is provided from the first tube. The second ribs are coupled to a second tube of the plurality of ribs. Each of the one or more tubes is, in part, in the interior area of the burner port and the one or more tubes are aligned substantially in parallel. The burner port includes a plurality of ribs in the interior area of the burner port. The burner port includes an inner port that is configured to receive mixed gas from the one or more tubes and that is coupled to the plurality of ribs, and an outer port that holds the inner port. The burner comprises a spark plug that is located adjacent to the heating element and that is configured to ignite mixed gas provided from the one or more tubes; and an ignition rib that is coupled to the burner port and that is configured to guide mixed gas flow toward the spark plug.

In general, one innovative aspect of the subject matter described in this specification can be embodied in a gas cooker comprising a case defining a case interior area, the case including a case opening to the case interior area; a plate covering, fully or in part, the case opening of the case; a burner that is located in the interior area of the case and that is configured to provide heat using mixed gas; a vent that is located at a first position of the case and that is configured to discharge burned gas from the interior area of the case to an exterior area of the case; and an insulating case that is coupled to the burner and that is configured to hold the burner, wherein the burner includes a burner port defining an interior area, the burner port including an opening to the interior area, one or more tubes that are coupled to the burner port and that are configured to provide mixed gas to the interior area of the burner port, a burner holder that holds the burner port and that is configured to guide mixed gas flow provided from the one or more tubes toward the vent, a heating element that is configured to cover the opening of the burner port and that is heated by gas-generated heat; a plurality of ribs that are configured to guide mixed gas flow provided from the one or more tubes and that are located in the interior area of the burner port, and a shielding plate that (i) is coupled between the heating element and the burner port, (ii) is configured to cover a first portion of the opening of the burner port, and (iii) is configured to spread mixed gas that is provided from the one or more tubes into the interior area of the burner port, wherein the first portion of the opening is oriented toward one or more coupling portions that couple the burner port to the one or more tubes.

The foregoing and other embodiments can each optionally include one or more of the following features, alone or in combination. In particular, one embodiment includes all the following features in combination. The gas cooker comprises a first member that is coupled to the burner holder and that is configured to delay burned gas flow that flows from the interior area of the burner port toward the vent. The gas cooker comprises a cooling unit that is coupled to the case and that is configured to generate air flow toward the vent. The burner holder includes a hole that is configured to allow air to flow from the exterior area of the case into the interior area of the case. The heating element is coupled to the burner holder. The shielding plate includes a plurality of holes, wherein mixed gas is configured to pass through the plurality of holes.

The details of one or more examples of the subject matter described in this specification are set forth in the accompanying drawings and the description below. Other potential features, aspects, and advantages of the subject matter will become apparent from the description, the drawings, and the claim.

BRIEF DESCRIPTION OF THE DRAWINGS

Like reference numbers and designations in the various drawings indicate like elements.

DETAILED DESCRIPTION

Figure 1:
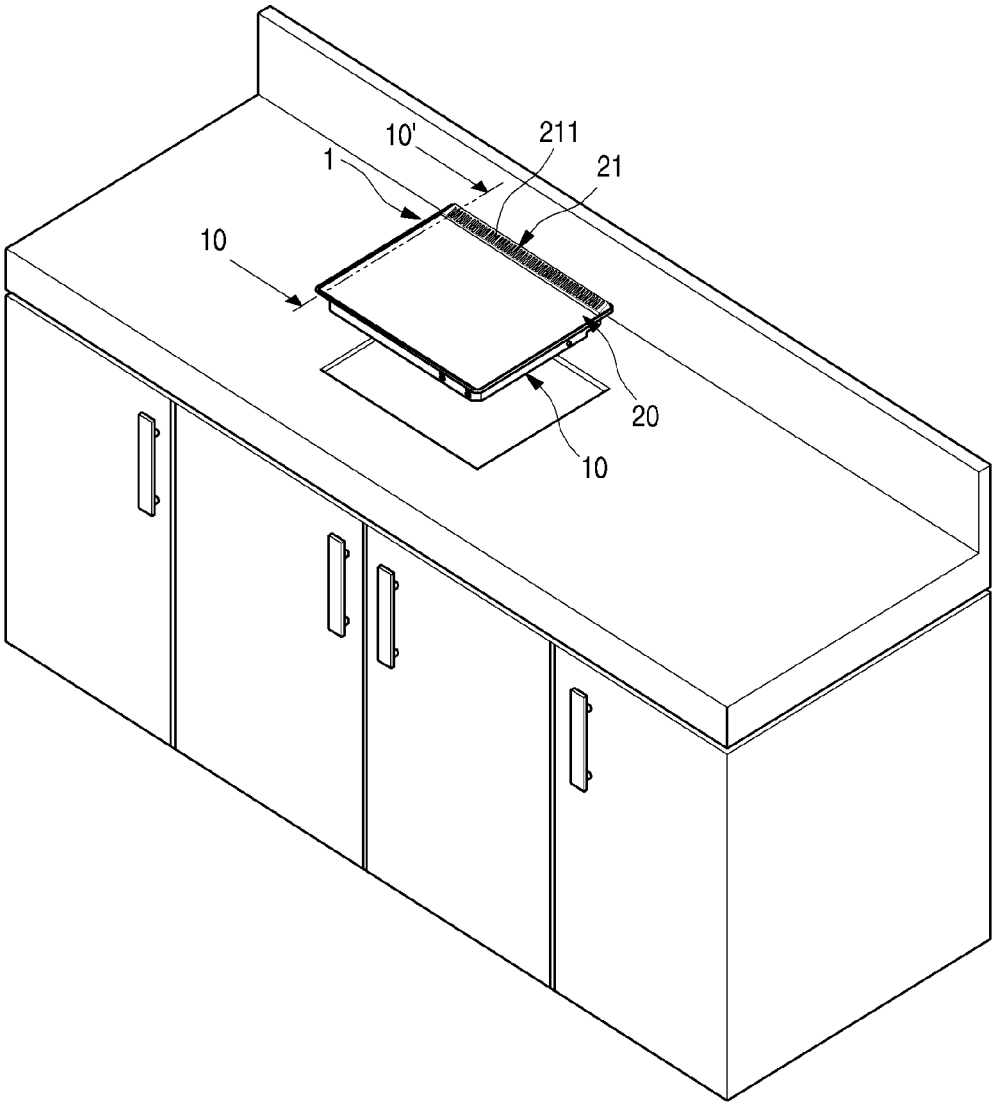
FIG. 1 is a diagram illustrating an example gas cooker.

FIG. 1 illustrates an example gas cooker.

As illustrated in the drawing, a gas cooker 1 according to an embodiment of the present invention may be installed at an upper surface of furniture such as a sink. The gas cooker 1 is formed to be seated in an opening formed at an upper surface of the sink, and an exterior thereof exposed through the upper surface of the sink may be formed by a plate 20.

And the entire exterior of the gas cooker 1 may be configured with a case 10, the plate 20 and a grille vent 21.

The case 10 may be formed of a plate-shaped steel material, and an upper surface thereof is bent to be opened, and thus a space in which a plurality of elements for operating the gas cooker 1 are accommodated is provided therein. And when the gas cooker 1 is installed at the sink, the case 10 is in an accommodated state inside the opening of the sink.

The plate 20 forming an upper surface of the gas cooker 1 is provided at the opened upper surface of the case 10. The plate 20 shields the opening of the sink while the gas cooker 1 is installed at the sink, is exposed through the upper surface, and forms the exterior of the upper surface of the gas cooker 1. And the plate 20 provides a flat surface on which food to be cooked is seated.

And the grille vent 21 through which exhaust gas is discharged is provided at a rear end of the plate 20. The grille vent 21 is formed to slightly protrude from the plate 20, and a plurality of vent holes 211 are opened at the grille vent 21 so that the exhaust gas is discharged through the vent holes 211.

Figure 2:
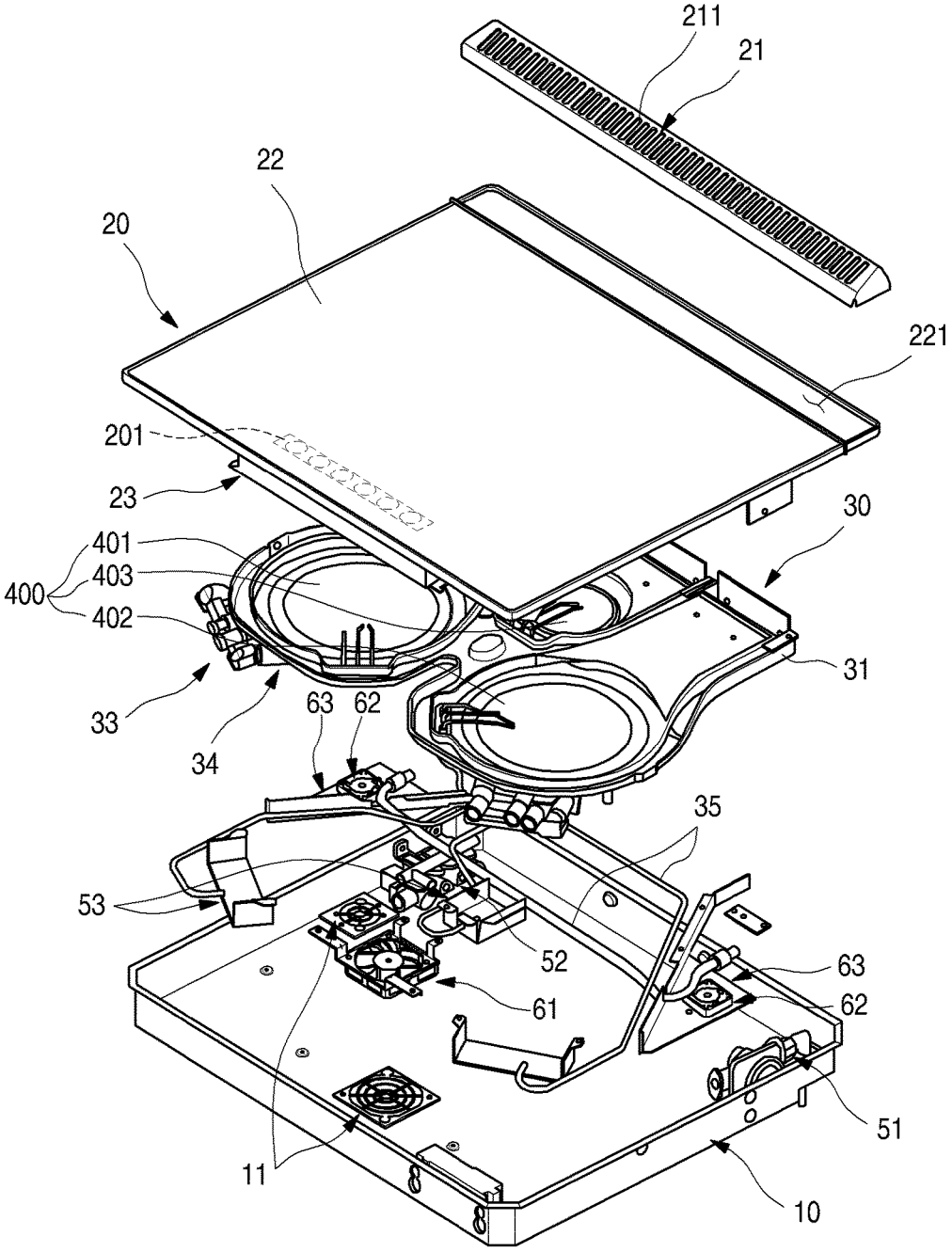
FIG. 2 is a diagram illustrating an inside area of an example gas cooker.
Figure 3:
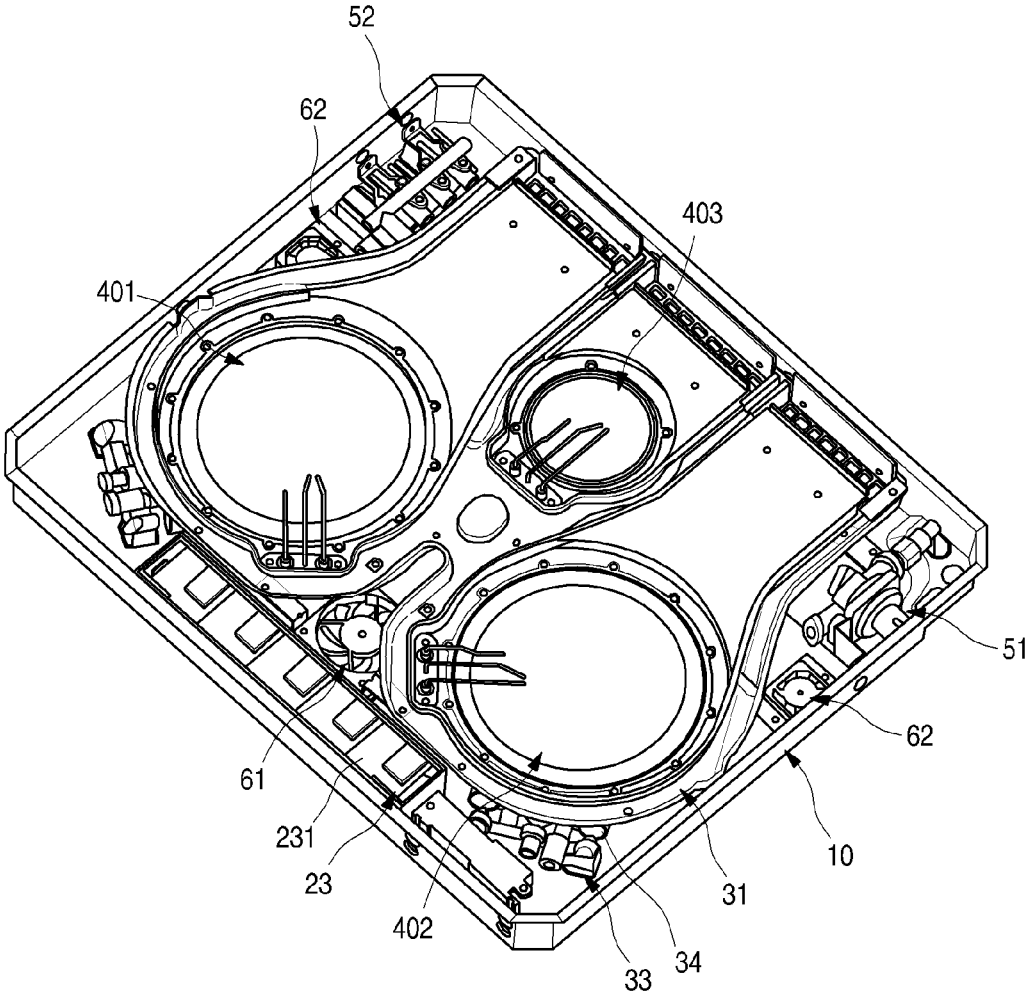
FIG. 3 is a diagram illustrating an inside area of an example gas cooker.
Figure 4:
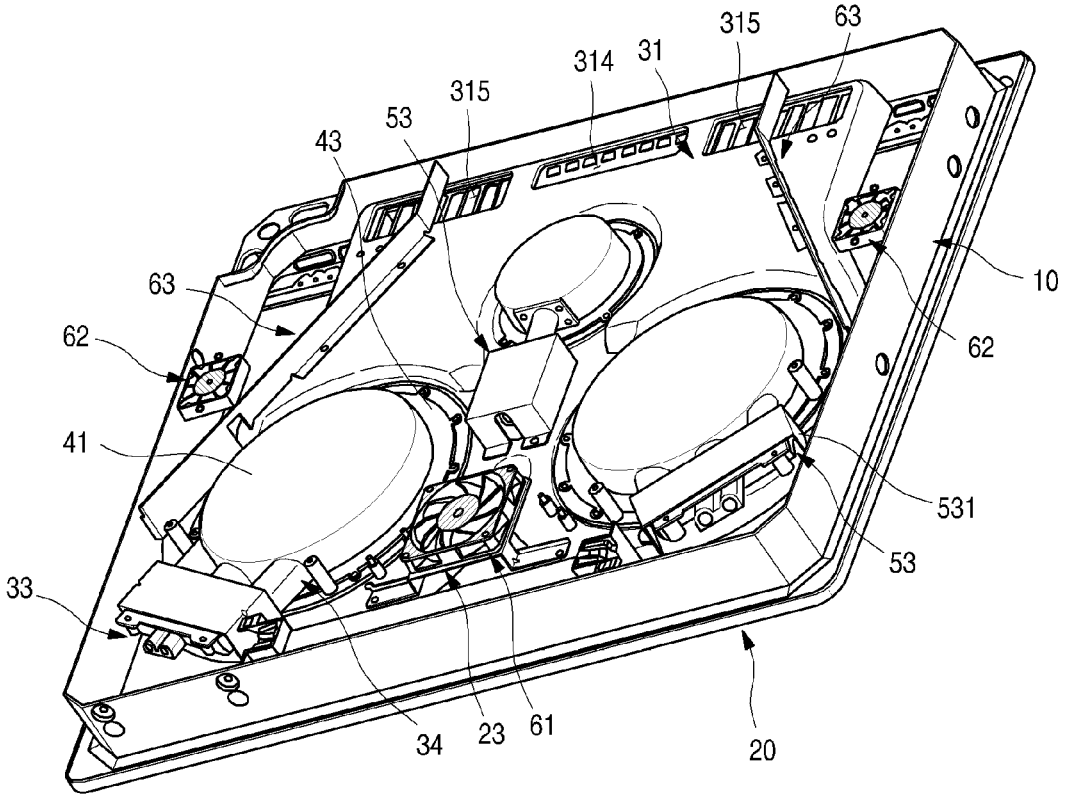
FIG. 4 is a diagram illustrating an inside area of an example gas cooker

FIGS. 2-4 illustrate an inside area of an example gas cooker.

A configuration of the gas cooker will be described in detail with reference to the drawings. The upper surface of the gas cooker 1 is formed by the plate 20, and the other exterior except the upper surface is formed by the case 10.

The plate 20 may be formed of a ceramic glass material, and a top frame 22 may be provided at a perimeter of the plate 20, and may form an exterior of the perimeter of the plate 20. And a grille vent seating portion 221 which is opened so that the grille vent 21 is seated therein may be further formed at the top frame 22.

An operation unit 23 may be provided under the plate 20. The operation unit 23 is operated to control heating power of the gas cooker 1 by a user, and may be formed to be operated by the user's touching operation. The operation unit 23 may be configured with an electronic switch or a sensor, instead of a touching method.

An operation part 201 which enables the user to recognize an operating portion of the operation unit 23 may be formed at an upper surface of the plate 20 corresponding to the operation unit 23. The operation part 201 may be formed at the upper surface of the plate 20 in a printing method or a film attaching method, and may also be formed in a transparent or translucent type so that at least a part of the operation unit 23 is exposed. Also, the operation part 201 may be formed not to be recognized from an outside through the plate 20 before an operation thereof, but to be recognized from the outside by turning on a separate backlight.

The operation unit 23 may be located at a front end of the plate 20, and may be formed so that an upper end of the operation unit 23 is in completely close contact with the plate 20. And the operation unit 23 may also be formed to be coupled to the plate 20 and thus to be disassembled from or assembled to the case 10 in a module state.

In some implementations, the opened upper surface of the case 10 may be formed to have a somewhat smaller area than that of the plate 20, and may also be formed to have a structure in which the perimeter of the plate 20 further protrudes to an outside of the case 10 when being coupled to the plate 20. And an exterior of the case 10 may be formed by bending the steel plate material, and if necessary, may be formed by injection-molding a resin material.

When the plate 20 and the case 10 are coupled to each other, a space is formed inside the case 10, and a burner unit 30 may be provided in the space. The burner unit 30 may include a plurality of burners 40 in which combustion of a supplied mixed gas occurs, and an insulating case 31 at which the burners 40 are fixed and installed.

Each of the burners 40 has a nozzle 33 for supplying the gas, and a mixing tube 34 through which a fuel gas and air are mixed and introduced to a burner port 41 may be provided at an outlet side of the nozzle 33. The nozzle 33 and the mixing tube 34 may be formed in one module, and may be respectively fixed to and installed at the burner port 41.

In some implementations, the plurality of burners 40 may be provided, and may include a first burner 401 and a second burner 402 which are provided at both of left and right sides inside the case 10, and a third burner 403 which is provided between the first burner 401 and the second burner 402 provided at both of the left and right sides and has a size smaller than each of the first burner 401 and the second burner 402. And all of the first burner 401, the second burner 402 and the third burner 403 may be seated on the insulating case 31, and may be installed inside the case 10. The number of burners 40 and a size of each of the burners 40, which are installed at the insulating case 31, are not limited to the proposed embodiment, and may be variously applied.

In some implementations, a gas pipe 35 is provided inside the case 10. The gas pipe 35 connects a regulator 51 and a valve unit 52 with the burners 40 so that the gas is supplied to each of the burners 40. At this point, the regulator 51 and the valve unit 52 which are operated by an electronic control method may be commonly referred to as electronic components. And a main fan 61 and a sub-fan 62 may be provided inside the case 10.

Figure 5:
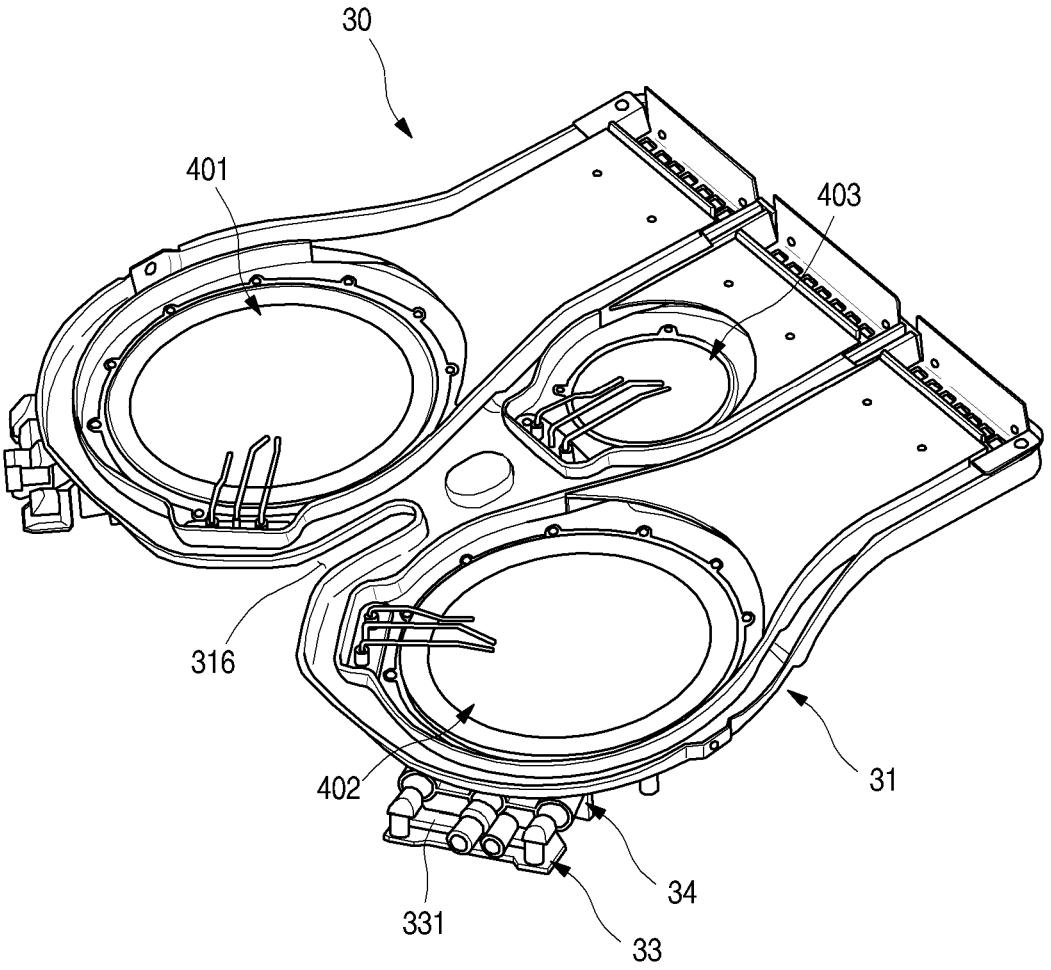
FIG. 5 is a diagram illustrating an example burner unit.
Figure 6:
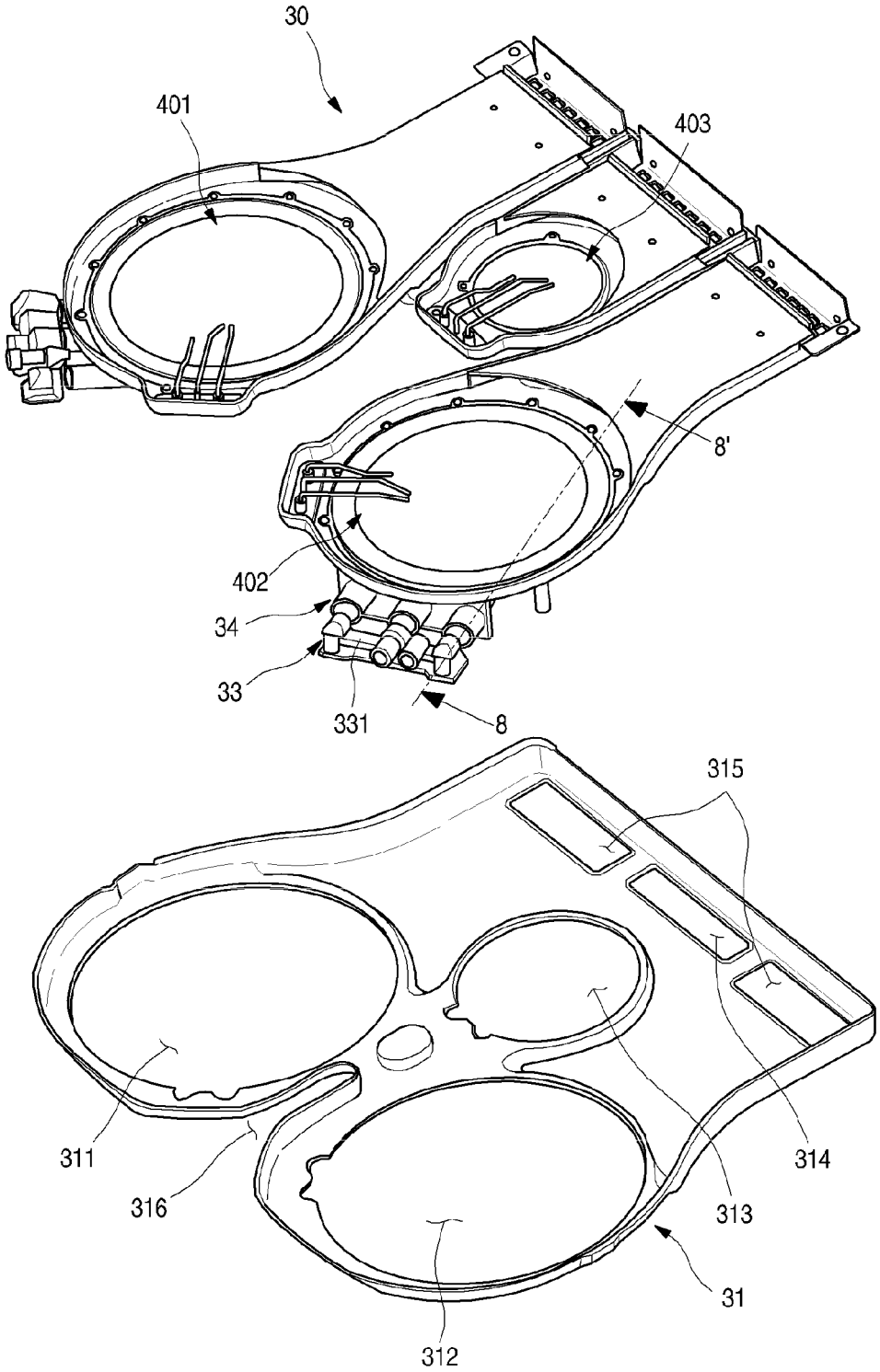
FIG. 6 is a diagram illustrating an example burner unit.

FIGS. 5-6 illustrate an example burner unit.

The burner unit 30 may include the plurality of burners 40, and the insulating case 31 at which the plurality of burners 40 are seated. The burners 40 may include the first burner 401 and the second burner 402 which are provided at both of the left and right sides, and the third burner 403 which is provided between the first burner 401 and the second burner 402. At this point, the third burner 403 may be located at a rear side slightly further than the second burner 402, and may have the size smaller than the first burner 401 and the second burner 402.

The insulating case 31 has a shape of which an upper surface is opened to accommodate the burners 40, and the insulating case 31 may have a structure in which an upper end thereof is in contact with the plate 20 or the upper surface thereof is shielded by the plate 20.

And a first burner hole 311, a second burner hole 312 and a third burner hole 313 at which the first burner 401, the second burner 402 and the third burner 403 are respectively located are formed at the insulating case 31 so as to be opened.

And an exhaust port through which exhaust gas generated by the combustion and internal air of the case 10 are discharged is formed at a rear end of the insulating case 31. The exhaust port may include a central exhaust port 314 formed at a center, and side exhaust ports 315 formed at both sides of the central exhaust port 314.

The central exhaust port 314 may be formed to be slightly narrower than an area of each of the side exhaust ports 315. This is to reduce an amount of high-temperature exhaust gas discharged through the central exhaust port 314 and thus to reduce a temperature of the entire exhaust gas because a distance between the central exhaust port 314 and the third burner 403 is relatively shorter than a distance between the first and second burners 401 and 402 and the side exhaust ports 315.

That is, an amount of exhaust gas discharged through the side exhaust ports 315 having a relatively low temperature may be enabled to be greater than that of exhaust gas discharged through the central exhaust port 314, and thus the temperature of the entire exhaust gas which is mixed and discharged may be reduced.

An opening portion 316 through which cooling air blown from the main fan 61 passes is formed at a front end of the insulating case 31. A lower surface of the plate 20 may be cooled through the opening portion 316, and particularly, the operation part 201 which is touched and operated by a user may be intensively cooled.

In some implementations, the number and an arrangement of the burners 40 installed at the insulating case 31 may be variously changed, and a structure of the insulating case 31 may be determined according to the number and the arrangement of the burners 40.

Hereinafter, a structure of each of the burners 40 will be described in detail. The burners 40 include the first burner 401, the second burner 402 and the third burner 403. However, each of the burners 40 is different only in the arrangement and a size thereof, and has the same basic structure. Therefore, hereinafter, a detailed structure of each of the burners 40 will be described based on the second burner 402. Since the first burner 401 and the second burner 402 have the same structure, detailed description thereof will be omitted.

Figure 7:
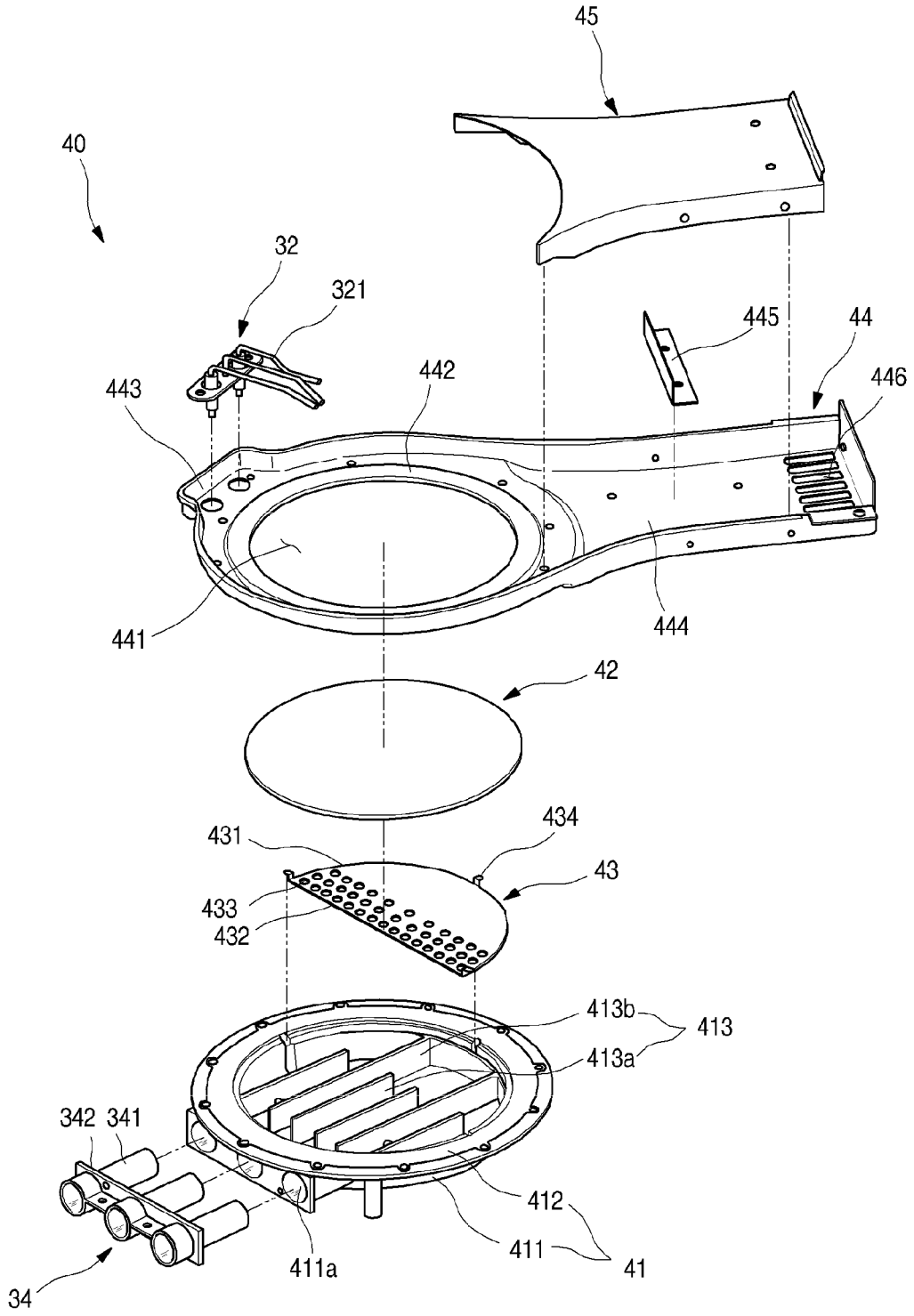
FIG. 7 is a diagram illustrating an example burner.
Figure 8:
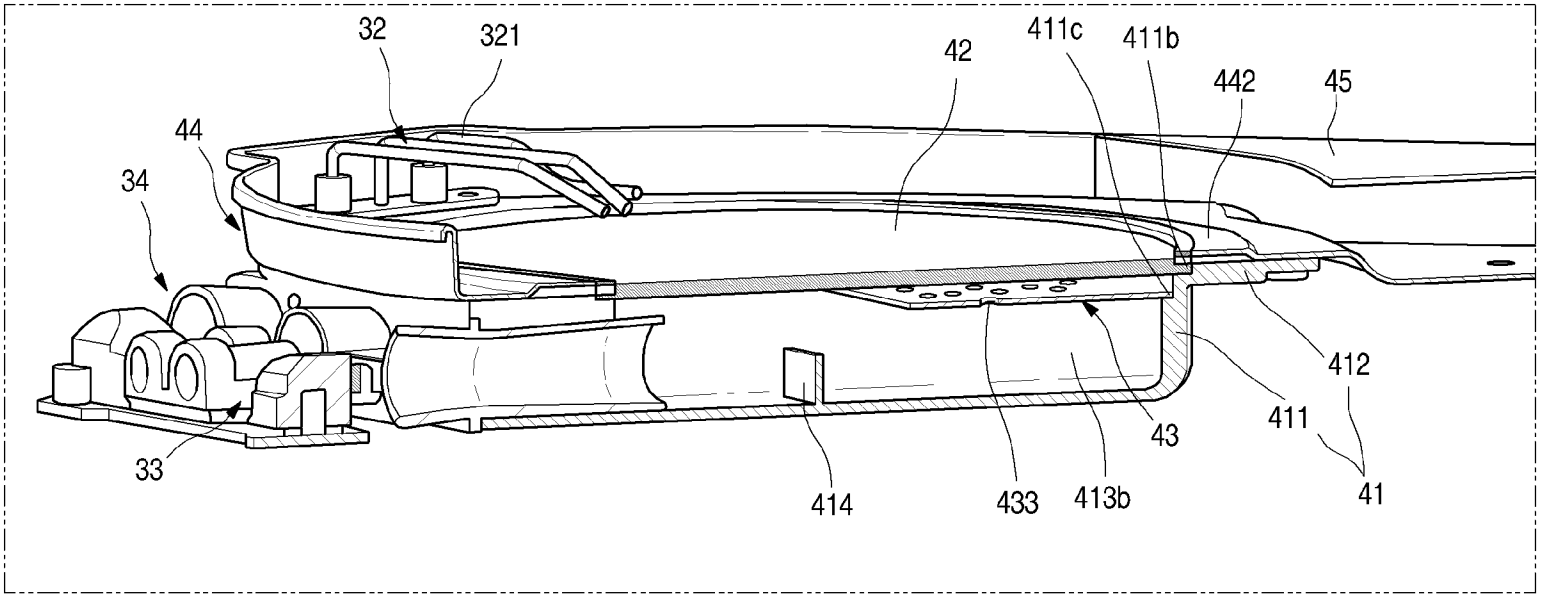
FIG. 8 is a diagram illustrating an inside area of the example burner unit of FIG. 6.
Figure 9:
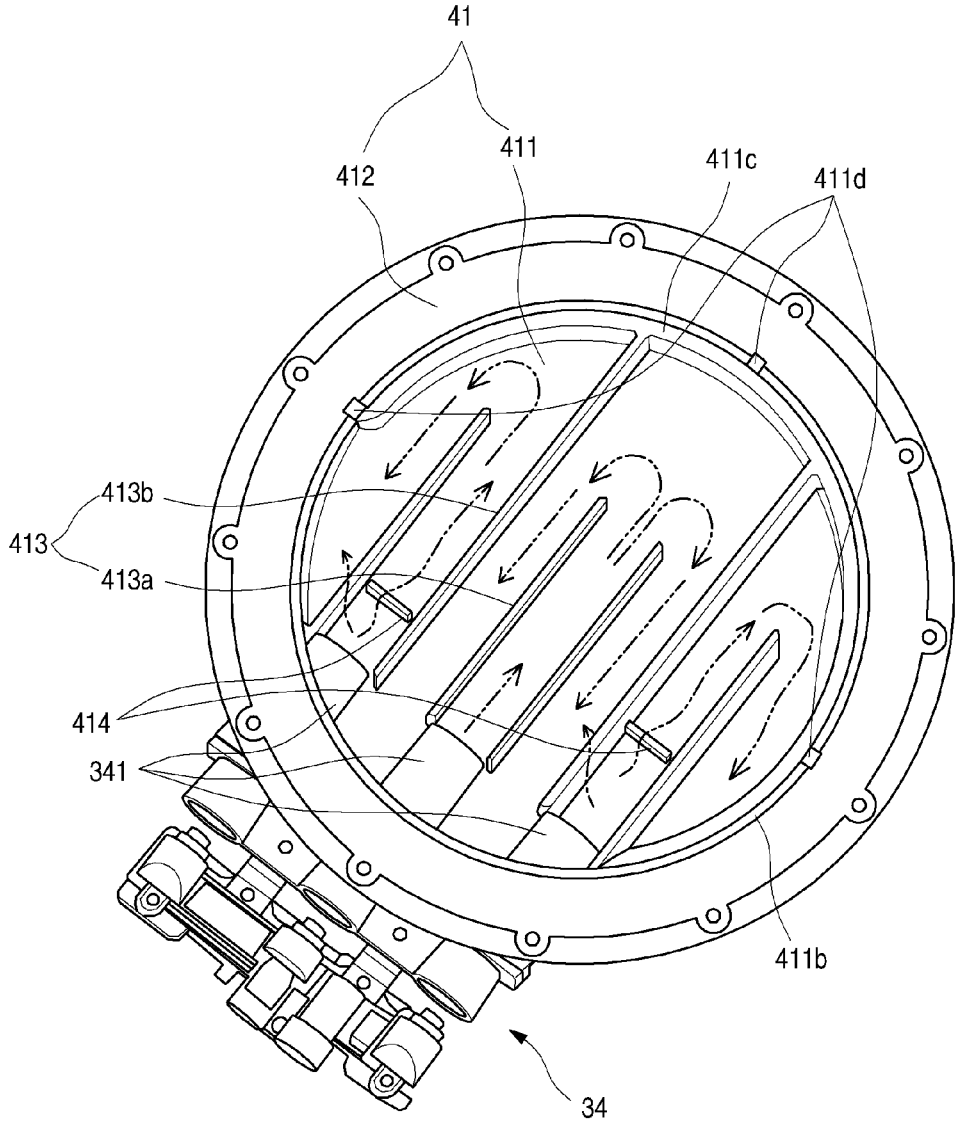
FIG. 9 is a diagram illustrating an example burner port.

FIG. 7 illustrates an example burner. FIG. 8 illustrates an inside area of an example burner unit of FIG. 6. FIG. 9 illustrates an example burner port.

As illustrated in the drawings, the burner 40 may include the burner port 41 to which the mixed gas is supplied, a heating element 42 which is seated at the burner port 41 to be heated by the combustion of the mixed gas, and a burner holder 44 and a burner cover 45 which support the burner port 41 and the heating element 42.

Specifically, the burner port 41 is formed in a circular shape which is opened upward. And the burner port 41 may include an accommodating portion 411 in which the mixed gas is accommodated, and a flange portion 412 which is bent outward from an end of the accommodating portion 411.

A tube insertion hole 411*a* in which the mixing tube 34 is inserted is opened at one side of an outer portion of the accommodating portion 411. The mixing tube 34 is inserted and installed into the burner port 41, and while the mixing tube 34 is installed, an inlet port of the mixing tube 34 protrudes to an outside of the accommodating portion 411, and an outlet port of the mixing tube 34 is located at a predetermined location inside the accommodating portion 411.

In some implementations, the mixing tube 34 may include a plurality of extension tubes 341 which are disposed to be spaced apart from each other, and a tube holder 342 which connects the extension tubes 341 and is fixed to and installed at the tube insertion hole 411*a*. Each of the extension tubes 341 extends from an outside of the burner port 41 toward an inside thereof, and outlet ports of the extension tubes 341 are located in the same depth inside the burner port 41.

The plurality of extension tubes 341 may be disposed at regular intervals so that the gas supplied through the nozzle 33 is evenly introduced into the burner port 41. In some implementations, three extension tubes 341 are provided, but two or more extension tubes 341 may be variously provided.

And a plurality of nozzles 33 through which the mixed gas is injected has a structure which is fixed by a nozzle holder 331, and an outlet port of each of the nozzles 33 is located at a location corresponding to an inlet port of each of the extension tubes 341.

That is, the inlet port of the mixing tube 34 is located at the location corresponding to the outlet port of the nozzle 33 to be spaced apart by a predetermined gap, such that air is mixed together by a pressure difference due to a flow of the gas when the gas is injected through the nozzle 33.

In some implementations, a plurality of distribution ribs 413 may be provided inside the accommodating portion 411. The distribution ribs 413 serve to enable the mixed gas introduced into the accommodating portion 411 to flow in one direction and then to flow again in an opposite direction, and extend upward from a bottom surface of the burner port 41. The distribution ribs 413 may be molded with the burner port 41, and may be integrally formed with the burner port 41.

At this point, each of the distribution ribs 413 is formed to have a height corresponding to a stepped plate seating portion 411*b* formed at an upper end of the accommodating portion 411. Therefore, while the heating element 42 is seated on the plate seating portion 411*b*, an upper end of each of the distribution ribs 413 is in contact with a lower end of the heating element 42, and the distribution ribs 413 form a flowing passage of the mixed gas.

And the distribution ribs 413 may include a first rib 413*a* which extends from an outlet port side of the mixing tube 34 so that an end thereof is spaced apart from a wall surface of the accommodating portion 411, and a second rib 413*b* which is disposed at a lateral side of the first rib 413*a* and extends from a wall surface facing the outlet port of the mixing tube 34 to the outlet port side of the mixing tube 34. The first rib 413*a* and the second rib 413*b* are disposed close to each other, and due to the first rib 413*a* and the second rib 413*b*, the mixed gas discharged from the mixing tube 34 flows in one direction and then flows again in the opposite direction.

In some implementations, an ignition rib 414 is formed at one side thereof, which is spaced apart from the outlet port of the mixing tube 34, to protrude upward. The ignition rib 414 may be formed to extend in a direction crossing a discharging direction of the mixed gas discharged from the outlet port of the mixing tube 34.

And the ignition rib 414 may be located close to an end of a spark plug 32. Therefore, the mixed gas discharged through the outlet port of the mixing tube 34 may flow upward by the ignition rib 414, and may easily ignite by the spark plug 32. The ignition rib 414 may be formed lower than the height of each of the distribution ribs 413, and may be formed to extend on the flowing passage formed by the distribution ribs 413 in a direction crossing the distribution ribs 413.

In some implementations, a shielding plate seating portion 411*c* at which a shielding plate 43 is installed is formed at a perimeter of an inner side surface of the accommodating portion 411. The shielding plate seating portion 411*c* is formed at an inner wall surface of the accommodating portion 411 facing the mixing tube 34, and formed to protrude to an inside of the accommodating portion 411, such that the shielding plate 43 is seated on an upper end thereof.

At this point, a length of the upper end of the shielding plate seating portion 411*c* may be formed to correspond to that of a curved portion 431 of the shielding plate 43. And a height of the shielding plate seating portion 411*c* is formed lower than that of the plate seating portion 411*b* so that an upper surface of the shielding plate 43 does not interfere with the heating element 42 while the shielding plate 43 is seated on the shielding plate seating portion 411*c*.

The shielding plate 43 is formed in a semi-circular plate shape to shield a part of an opened upper surface of the accommodating portion 411. The curved portion 431 of the shielding plate 43 is formed to have a curvature corresponding to an outer circumference of the accommodating portion 411. Therefore, the shielding plate 43 may be seated on the shielding plate seating portion 411*c*, and may shield the opened upper surface of the accommodating portion 411. And a straight portion 432 is located at a location facing the mixing tube 34. The straight portion. 432 is located at a front side further than an end of the first rib 413*a*, i.e., a side of the mixing tube 34.

Therefore, the mixed gas introduced through the mixing tube 34 flows through the flowing passage, and then flows again via a lower side of the shielding plate 43 in the opposite direction. At this point, the shielding plate 43 may shield the supplied mixed gas from flowing through an upper side thereof.

And a plurality of distribution holes 433 may be formed at the shielding plate 43. The distribution holes 433 is formed from the straight portion 432 of the shielding plate 43 toward the curved portion 431 so that the number thereof is gradually reduced from the straight portion 432 toward the curved portion 431. That is, a portion of the mixed gas strongly discharged from the mixing tube 34 may come around in the direction opposite to the discharging direction by the shielding plate 43 and the distribution ribs 413, and another portion thereof may be supplied upward through the distribution holes 433.

In some implementations, an installation protrusion 434 protrudes from the curved portion 431 of the shielding plate 43, and an installation groove 411*d* matched with the installation protrusion 434 is formed at a corresponding portion of the shielding plate seating portion 411*c*. Therefore, the shielding plate 43 may be maintained in a stably installed state at the upper end of the accommodating portion 411.

The heating element 42 is seated on the plate seating portion 411*b* formed at the upper end of the accommodating portion 411. The heating element 42 is formed to completely shield the opened upper surface of the accommodating portion 411. The heating element 42 may be formed of a porous ceramic mat, and the mixed gas flowing upward at the accommodating portion 411 may be burned at the heating element 42. The heating element 42 may be formed of another material which is usable at the radiant burner 40.

The burner port 41 is seated at the burner holder 44. A burner hole 441 is opened at the burner holder 44, and the burner port 41 is inserted into the burner hole 441. At this point, a port seating portion 442 formed to be stepped is formed at a circumference of the burner hole 441, and the flange portion 412 of the burner port 41 is seated at the port seating portion 442. And a fastening member passing through the flange portion 412 may be fastened to the port seating portion 442, and thus the burner port 41 may be fixed to and installed at the burner holder 44.

And a plug installing portion 443 is formed at one side of the burner holder 44. The spark plug 32 is fixed to and installed at the plug installing portion 443. The spark plug 32 serves to ignite the mixed gas in the burner 40, is provided above the heating element 42, and extends from an outside of the heating element 42 toward an inside thereof to ignite the mixed gas.

Also, a flame detecting unit 321 may be provided at one side of the spark plug 32. The flame detecting unit 321 serves to check an ignition state of the burner 40 through a change in a voltage or a temperature of the heating element 42, and may be formed in a module integrally formed with the spark plug 32, and may extend along with the spark plug 32 from an upper side of the heating element 42 toward the inside of the heating element 42.

And a burned gas guide portion 444 formed to extend backward is formed at the burner holder 44. The burned gas guide portion 444 may extend to a rear end of the case 10 corresponding to a location of the grille vent 21. Therefore, the burned gas generated when the combustion occurs at the burner 40 may be guided to the grille vent 21 along the burner holder 44, and then may be discharged to an outside.

At this point, the burned gas guide portion 444 is spaced apart from a rear surface of the case 10, and a passage P through which the cooling air flows may be formed between a rear surface of the burned gas guide portion 444 and the rear surface of the case 10.

And a reheating member 445 extending in a direction crossing a flowing direction of the burned gas is provided on the burned gas guide portion 444. The reheating member 445 extends to cross the burned gas guide portion 444, and is formed to extend upward, such that a flow of the burned gas flowing along the burned gas guide portion 444 temporarily stays, and thus the burned gas temporarily stays above the heating element 42, and thermal efficiency is increased, and initial ignition is easily performed.

A plurality of cooling holes 446 are formed at a rear end of the burned gas guide portion 444. The cooling holes 446 are located at positions corresponding to the exhaust ports 314 and 315 so that the cooling air introduced through the exhaust ports 314 and 315 is mixed with the high-temperature burned gas discharged through the burned gas guide portion 444, and then discharged to the grille vent 21.

The burner cover 45 is provided above the burned gas guide portion 444. The burner cover 45 forms a flow path of the burned gas flowing through the burned gas guide portion 444, and shields an opened upper side of the burned gas guide portion 444. And a rear end of the burner cover 45 is formed to be spaced apart from the rear end of the burned gas guide portion 444, such that cooling air passed through the cooling holes 446 and the burned gas passing through the burned gas guide portion 444 are mixed and then discharged.

In some implementations, although not illustrated, an insulator for preventing heat of the burner unit 30 from being transferred to the outside of the case 10 or some areas of the plate 20 may be provided between the burner holder 44 and the plate 20 and between the burner holder 44 and the insulating case 31.

Figure 10:
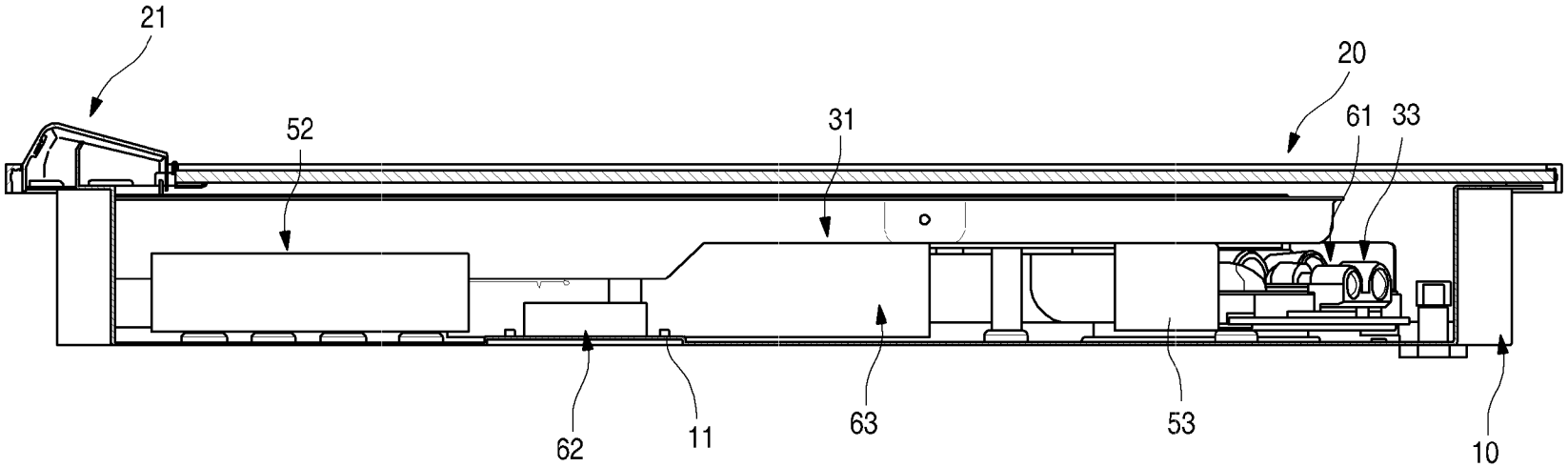
FIG. 10 is a diagram illustrating an example cross-sectional view of the example gas cooker of FIG. 1.
Figure 11:
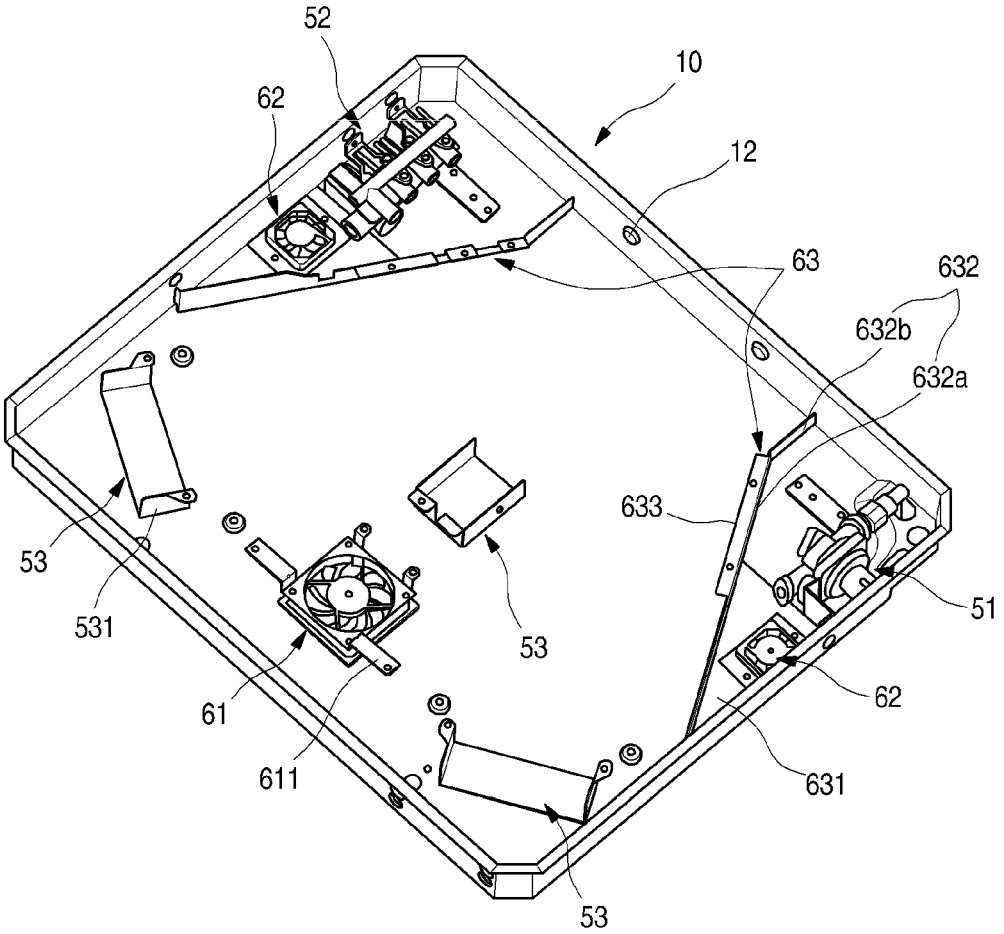
FIG. 11 is a diagram illustrating an example valve unit and an example regulator.
Figure 12:
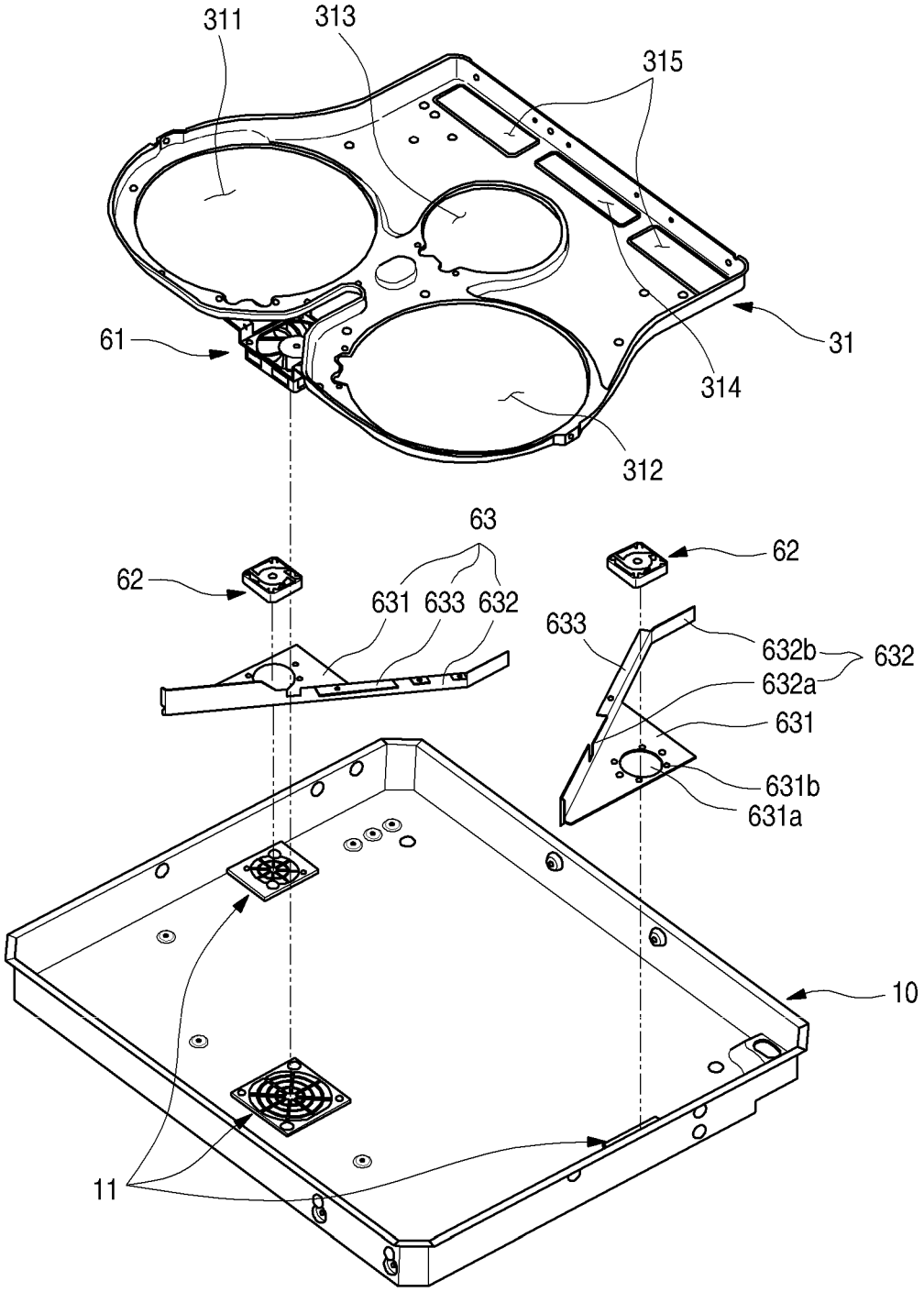
FIG. 12 is a diagram illustrating an example case, an example insulating case, and an example fan.

FIG. 10 illustrates an example cross-sectional view of the example gas cooker of FIG. 1. FIG. 11 illustrates an example valve unit and an example regulator. FIG. 12 illustrates an example case, an example insulating case, and an example fan.

As illustrated in the drawings, the main fan 61 and the sub-fan 62 for flowing air in the case 10 may be provided inside the case 10. Each of the main fan 61 and the sub-fan 62 is formed to have a box fan, and also formed to suction air outside the case 10 and then to discharge the suctioned air from an inside of the case 10. In some implementations, a structure of the fan may be employed according to a user's selection.

The main fan 61 and the sub-fan 62 enable external air to be introduced to the inside of the case 10 having a sealed structure, and simultaneously enable the air inside the case 10 to forcibly flow and thus to cool the inside of the case 10. And the air forcibly flowing in the case 10 may be discharged to an outside through the grille vent 21.

And the main fan 61 may be provided between the first burner 401 and the second burner 402, and may be provided among the first burner 401, the second burner 402 and the operation unit 23. That is, the main fan 61 is located at a location formed among the operation unit 23, the first burner 401 and the second burner 402.

The air forcibly flows toward the operation unit 23 by driving of the main fan 61, and thus may cool a PCB 231 forming the operation unit 23. Through cooling of the PCB 231, the operation unit 23 and the operation part 201 of the plate 20 may be cooled so that the user does not feel discomfort due to heat generated when operating the operation part 201 of the plate 20.

And by the driving of the main fan 61, the air outside the case 10 is introduced, and forcibly flows radially centering on the case 10, and some of the air may flow along perimeters of the first burner 401 and the second burner 402, and thus heat from the first burner 401 and the second burner 402 does not stay at the inside of the case 10, but is discharged to the outside.

Therefore, the internal space of the case 10 may be cooled by the driving of the main fan 61, and may also protect electronic components in the case 10, i.e., the PCB 231 and sensors forming the operation unit 23.

The sub-fan 62 serves to cool the regulator 51 and the valve unit 52 provided at both of the left and right sides in the case 10, and is provided at each of the left and right sides of the case 10. And the sub-fan 62 is provided inside a space partitioned by a cooling barrier 63, and by the cooling barrier 63, a space in which the regulator 51 and the valve unit 52 are disposed may be partitioned from the space in which the burner 40 is provided. Therefore, by driving of the sub-fan 62, the air outside the case 10 may be introduced into the space partitioned by the cooling barrier 63, and the regulator 51 and the valve unit 52 may be cooled separately from the space in which the burner 40 is disposed.

In some implementations, a fan installing portion 11 is formed at a bottom surface of the case 10 on which the main fan 61 and the sub-fan 62 are installed. The fan installing portion 11 may be formed to protrude in a shape corresponding to the main fan 61 and the sub-fan 62, such that the main fan 61 and the sub-fan 62 are seated thereat.

Since the case 10 has a structure in which the remaining portions except the fan installing portion 11 are sealed, the air introduced into the case 10 may be enabled only through the fan installing portion 11.

Therefore, the main fan 61 and the sub-fan 62 may have a structure which is in completely close contact with the case 10, and the suctioned air may be prevented from leaking through a gap between the case 10 and the main fan 61 or the sub-fan 62.

The fan installing portion 11 may be formed to protrude by a foaming when the case 10 is molded, and a grille shape may be formed at an opening of a protruding upper surface of the fan installing portion 11, and thus a foreign substance is prevented from being introduced while the air is suctioned.

And a nozzle bracket 53 for protecting the nozzle 33 and the mixing tube 34 is further provided at the case 10. The nozzle bracket 53 is fixed to and installed at the bottom surface of the case 10 corresponding to a location at which the nozzle 33 is installed, and also bent to cover an outside of the nozzle 33.

Specifically, both of side ends of the nozzle bracket 53 are bent upward, and form a shielding portion 531, and the shielding portion 531 shields one side of each of the nozzle 33 and the mixing tube 34 including a space between the nozzle 33 and the mixing tube 34, and thus the air forcibly blown by rotation of the main fan 61 is prevented from being introduced into the space between the nozzle 33 and the mixing tube 34 and having an influence on supplying of the mixed gas.

As illustrated in the drawings, the regulator 51 which constantly adjusts a pressure of the gas supplied from an outside and the valve unit 52 which selectively supplies the gas supplied from the regulator 51 to the burner port 41 may be provided inside the case 10.

The regulator 51 and the valve unit 52 may be disposed at both corners of a rear end inside the case 10 in consideration of an arrangement and a structure of the burner unit 30 provided inside the case 10. The regulator 51 and the valve unit 52 are located in opposite directions to each other, and formed to be connected to each other by the gas pipe 35 such that the gas is supplied thereto.

And the sub-fan 62 is provided in front of each of the regulator 51 and the valve unit 52. The sub-fan 62 which serves to suction the air outside the case 10 into the case 10, then to blow the air toward the regulator 51 and the valve unit 52, and thus to cool the regulator 51 and the valve unit 52 may be disposed at the left and right sides of the case 10.

The cooling barrier 63 is provided at the left and right sides inside the case 10. The cooling barrier 63 provides an installing surface of the sub-fan 62, also enables the air blown by the sub-fan 62 to effectively cool the regulator 51 and the valve unit 52, and enables the air to be discharged toward the grille vent 21.

Both ends of the cooling barrier 63 are fixed to and installed at a side surface and the rear surface of the case 10, respectively, and provide a space in which the regulator 51 or the valve unit 52 and the sub-fan 62 are disposed. A space partitioned by the cooling barrier 63 is an outer area of the burner unit 30 which may form a space in the case 10 to be separated from the burner unit 30.

Therefore, the air forcibly flowing by an operation of the sub-fan 62 may effectively cool the space in the area partitioned by the cooling barrier 63. That is, the external air suctioned by the sub-fan 62 is not mixed with the high-temperature air in the space in which the burner unit 30 is disposed, and thus may more effectively cool the regulator 51 and the valve unit 52.

The cooling barrier 63 may be fixed to and installed at a lower surface of the insulating case 31, and may connect between the insulating case 31 and the case 10 to partition a space.

Figure 13:
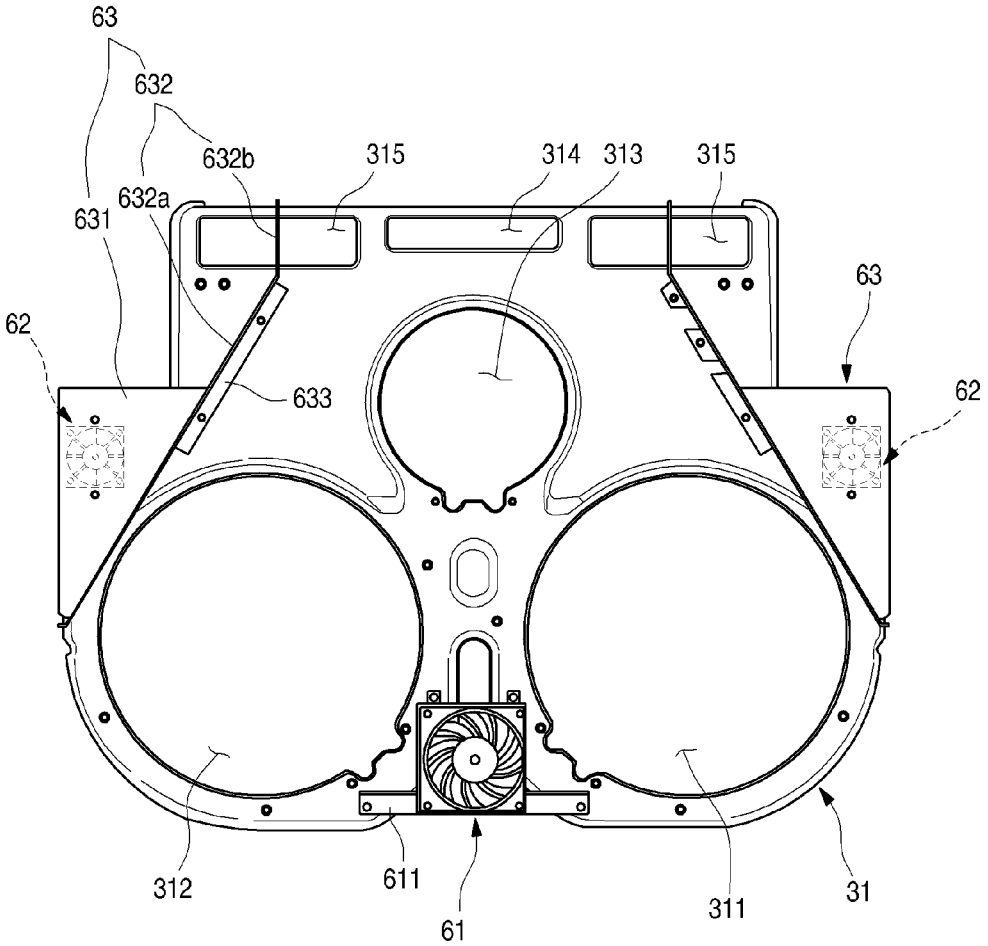
FIG. 13 is a diagram illustrating an example insulating case.
Figure 14:
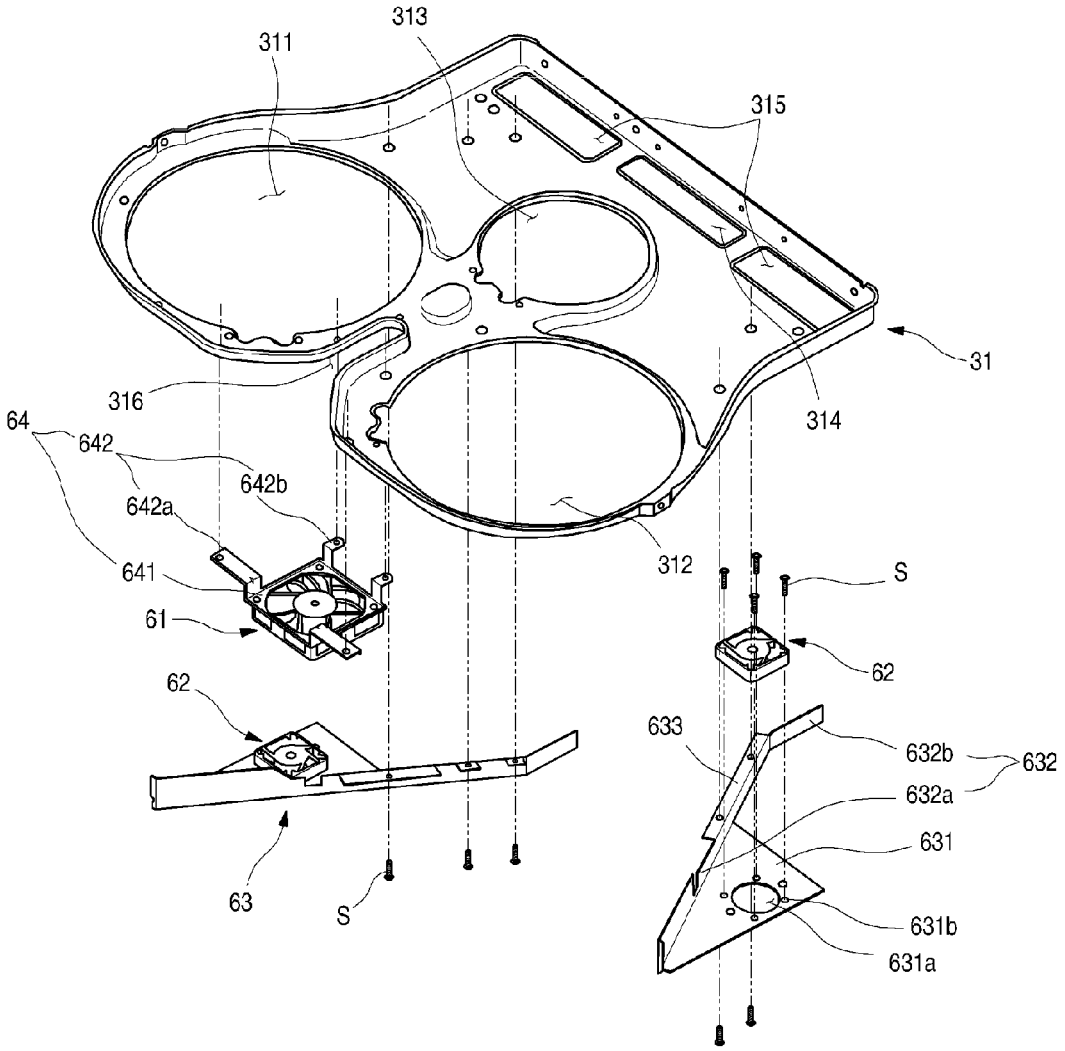
FIG. 14 is a diagram illustrating an example insulating case, an example sub-fan, and an example cooling barrier.

FIG. 13 illustrates an example insulating case. FIG. 14 illustrates an example insulating case, an example sub-fan, and an example cooling barrier.

The main fan 61, the sub-fan 62 and the cooling barrier 63 may be provided at the lower surface of the insulating case 31.

The main fan 61 is fixed to and installed at the lower surface of the insulating case 31 by a main fan bracket 611, and may be disposed between the first burner hole 311 and the second burner hole 312. And the main fan bracket 611 enables the main fan 61 to be installed to be spaced apart from the insulating case 31, and may also be formed to extend at a height at which the main fan 61 is in completely close contact with the fan installing portion 11.

And the cooling barrier 63 is fixed to and installed at both of left and right sides of the insulating case 31. The cooling barrier 63 may be fixed by a welding, or may be fixed to and installed at the insulating case 31 by a separate fastening member S such as a rivet, a bolt and a screw.

The cooling barrier 63 may generally include a fan seating portion 631 providing a surface on which the sub-fan 62 is seated, and a partitioning portion 632 which partitions the internal space of the case 10.

Specifically, the fan seating portion 631 is formed in an approximately triangular plate shape, and also formed to be in contact with the upper surface of the fan installing portion 11. And an opening 631*a* through which the air is introduced and a coupling hole 631*b* to which the fastening member S is fastened are formed at the fan seating portion 631. The fastening member S passes through the sub fan 62 and the coupling hole 631*b*, and is fastened thereto. Therefore, the sub-fan 62 may be fixed to the fan seating portion 631 by fastening the fastening member S, and the cooling barrier 63 installed at the insulating case 31 may be assembled inside the case 10 together with the insulating case 31. At this point, the sub-fan 62 and the fan seating portion 631 on which the sub-fan 62 is seated may be installed to be in completely close contact with the protruding fan installing portion 11.

And the fan seating portion 631 is formed in a right-angled triangular shape, and also formed so that one inclined end thereof is connected to the partitioning portion 632, and the other end is in close contact with the side surface of the case 10. Therefore, the cooling barrier 63 may be maintained in a stably fixed state without vibration due to an air flow.

The partitioning portion 632 is formed to be vertically bent upward from the inclined end of the fan seating portion 631, and also formed to be fixed to a lower end of the insulating case 31 and to partition the internal space of the case 10.

And the partitioning portion 632 extends along the inclined end of the fan seating portion 631, may further extend outward, and thus may include a first partitioning portion 632*a* which partitions the case 10, and a second partitioning portion 632*b* which is bent from an end of the first partitioning portion 632*a* and partitions the side exhaust port 315.

The first partitioning portion 632*a* is formed to partition a space between the insulating case 31 and the case 10, and to guide the flow of the air blown by the sub-fan 62.

And the second partitioning portion 632*b* is bent from the end of the first partitioning portion 632*a*, passes through the side exhaust port 315, and extends to be in contact with the rear end of the case 10. Accordingly, by the second partitioning portion 632*b*, the side exhaust port 315 may be divided into both of left and right sides based on the second partitioning portion 632*b*, and the cooling air flowing along the first partitioning portion 632*a* may be independently discharged through the side exhaust port 315 partitioned by the second partitioning portion 632*b*.

In some implementations, a bent portion 633 which is bent outward may be further formed at an upper end of the first partitioning portion 632*a*. The bent portion 633 is in contact with the lower surface of the insulating case 31. And the fastening member S such as a screw and a bolt may be fastened to the bent portion 633 and the insulating case 31, and thus the cooling barrier 63 may be fixed and installed.

Hereinafter, an operation of the gas cooker having such a configuration will be described.

Figure 15:
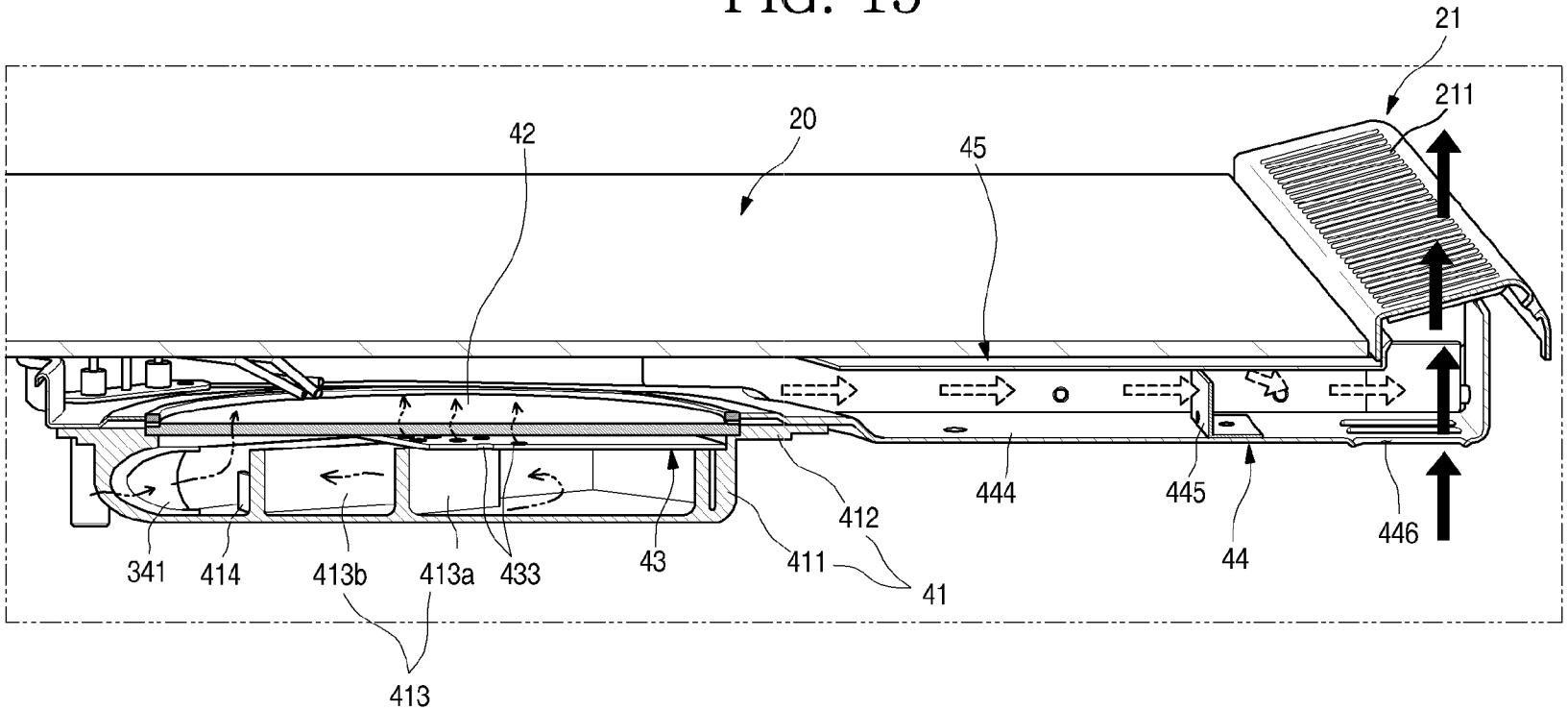
FIG. 15 is a diagram illustrating an example operation of an example burner.

FIG. 15 illustrates an example operation of an example burner.

As illustrated in the drawing, the user operates the operation part 201 exposed to the plate 20 to use the gas cooker 1. By operating the operation part 201, an operating signal may be input through the operation unit 23. Opening and closing of the valve unit 52 is determined by the input operating signal, and the gas is injected from the corresponding nozzle 33 toward the mixing tube 34.

At this time, the plurality of nozzles 33 supply the gas to the extension tubes 341, respectively, and while the gas is injected toward the inlet port of each of the extension tubes 341, the air in this area is also mixed and introduced into the burner port 41.

The mixed gas supplied into the burner port 41 is introduced into the accommodating portion 411, and then some of the gas flows upward by the ignition rib 414, and is supplied toward the heating element 42 close to the spark plug 32. Therefore, even at an initial supply stage of the mixed gas, the ignition may be effectively performed by the spark plug 32.

And some of the mixed gas introduced into the burner port 41 flows in one direction by the distribution rib 413, and then flows again in the opposite direction. At this point, an upper surface of a portion at which a flowing direction of the mixed gas is changed is shielded by the shielding plate 43, and thus the mixed gas may not flow upward, but may flow in the opposite direction.

And a portion of the mixed gas passing under the shielding plate 43 passes through the distribution holes 433, and flows toward the heating element 42, and the remaining portion thereof changes a direction thereof and then flows. And the mixed gas flowing in the opposite direction deviates from the shielding plate 43, naturally flows upward, and flows toward the heating element 42.

Like this, the mixed gas supplied into the accommodating portion 411 may be evenly distributed into the accommodating portion 411 by the distribution rib 413 and the shielding plate 43, and thus may be evenly supplied to entire heating element 42. Therefore, a flame may be uniformly formed on the heating element 42.

The burned gas generated by the combustion on the heating element 42 flows along the burned gas guide portion 444. At this point, a flow of the burned gas may temporarily stay by the reheating member 445, and while the burned gas stays above the heating element 42, the combustion may additionally occur, and thus the combustion efficiency may be further enhanced.

And the high-temperature burned gas passed through the reheating member 445 is mixed with the cooling air discharged from a rear of the burned gas guide portion 444 toward the grille vent 21, and thus may be discharged to an outside through the grille vent 21 while a temperature thereof is lowered.

In some implementations, the user may control heating power of the burner 40 through the operation of the operation part 201, and may also visually check an ignition state and a heating state through the plate 20 because visible rays are included in the radiant wave generated upon the ignition and the heating of the burner 40.

Figure 16:
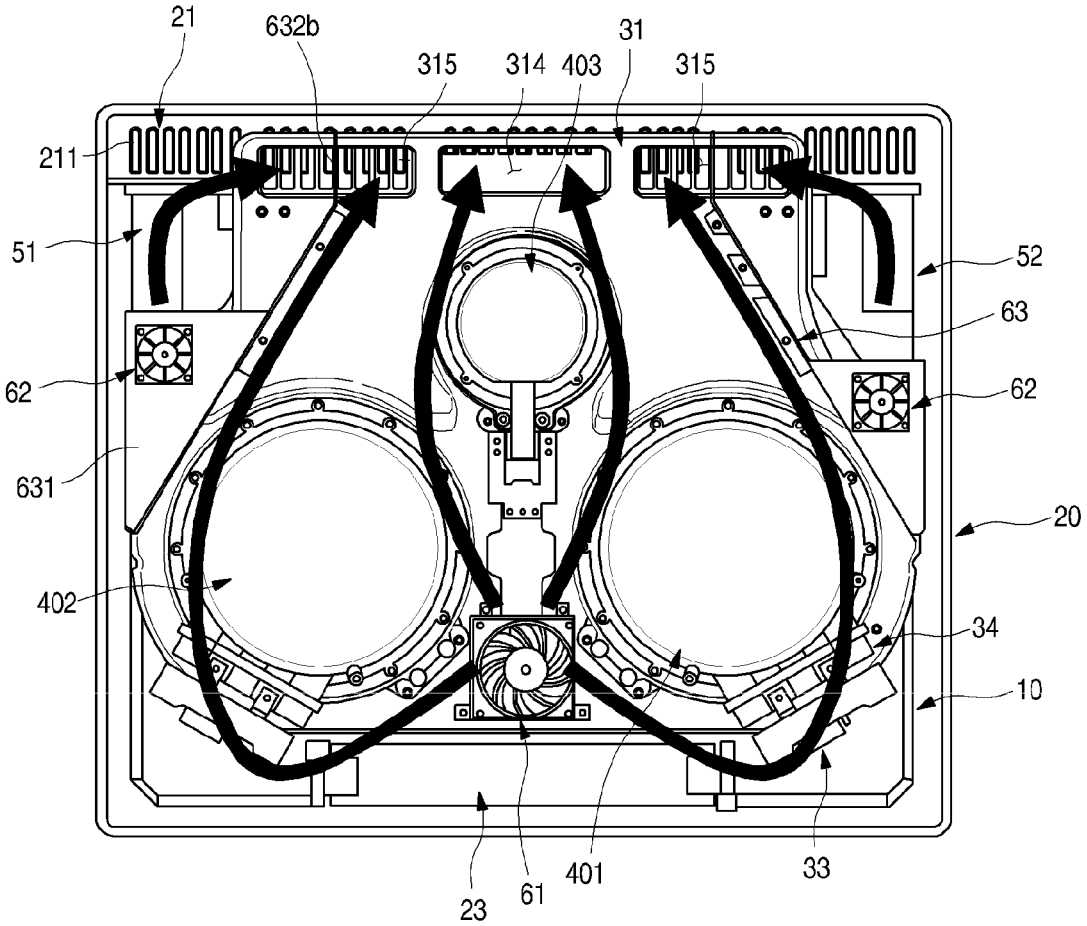
FIG. 16 is a diagram illustrating an example air flow of an example gas cooker.

FIG. 16 illustrates an example air flow of an example gas cooker.

As illustrated in the drawing, the main fan 61 and the sub-fan 62 are driven along with the ignition of the burner 40. By the driving of the main fan 61, the air in the case 10 may be suctioned toward the main fan 61. The suctioned air is discharged radially centering on the main fan 61.

Some of the air blown through the main fan 61 flows toward the PCB 231 of the operation unit 23, and thus the PCB 231 is continuously cooled to be normally operated.

And a portion of the air blown through the main fan 61 may pass between the first burner 401 and the second burner 402, and then may be discharged to the central exhaust port 314 along an outer side surface of the third burner 403.

And the remaining portion of the air blown through the main fan 61 flows along a space among the first burner 401, the second burner 402 and the side surface of the case 10, flows along the cooling barrier 63 which partitions the internal space of the case 10, and then may be discharged to one side of the side exhaust port 315.

As described above, by rotation of the main fan 61, the air in the case 10 does not stay, but continuously cools the front half portion of the plate 20 at which the operation unit 23 is located, and the air close to the first burner 401, the second burner 402 and the third burner 403 is discharged, and thus an internal temperature of the case 10 is prevented from being increased to a preset temperature or more.

And by the flow of the cooling air discharged through the central exhaust port 314 and the side exhaust port 315, the burned gas generated upon the combustion in the first burner 401, the second burner 402 and the third burner 403 may be mixed with the cooling air by a pressure difference, and may be discharged together. At this point, the high-temperature burned gas is mixed with the cooling air discharged from the inside of the case 10, and is in a low-temperature state, and then may be discharged to the outside through the vent holes 211 of the grille vent 21.

In some implementations, when the sub-fan 62 is driven, the air outside the case 10 may be introduced into the case 10, and thus may independently cool the internal space formed at each of both sides of the case 10 partitioned by the cooling barrier 63.

In some implementations, a burner port may have a structure which includes an outer port and an inner port and is assembled to each other, and the arrangement of the distribution holes may also be formed differently from the previous example.

In some implementations, structures of the burner port and the shielding plate can be changed.

Figure 17:
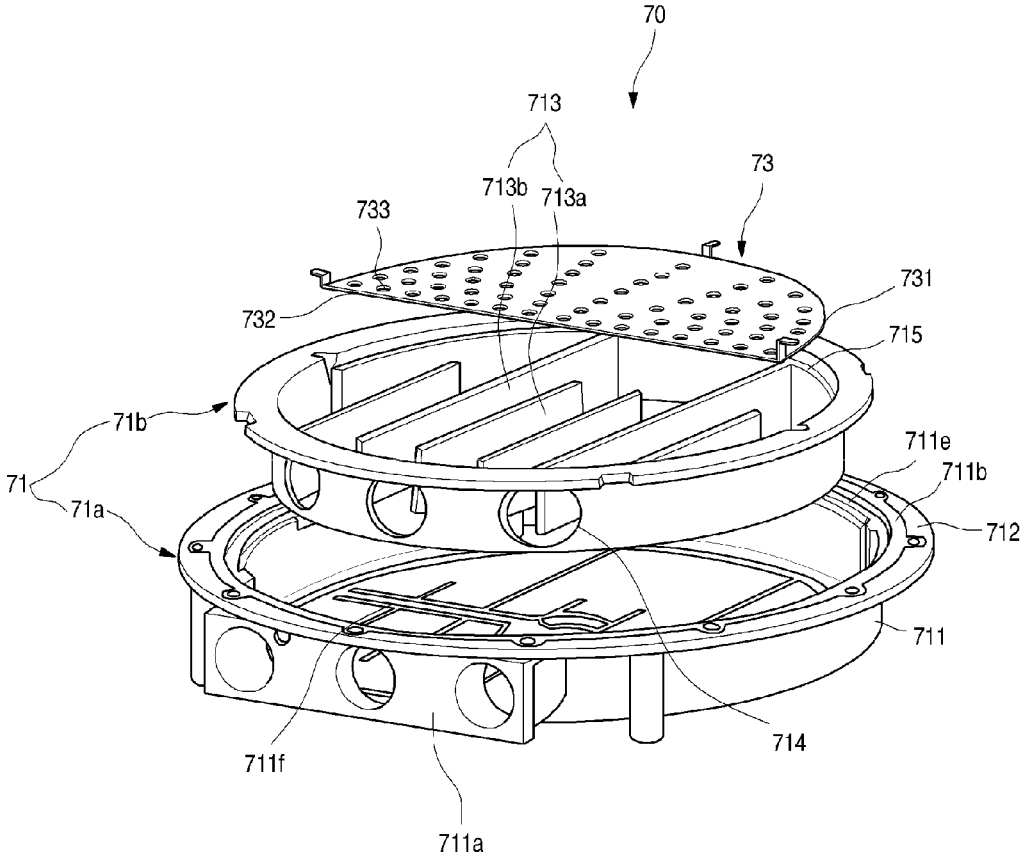
FIG. 17 is a diagram illustrating an example burner.

FIG. 17 illustrates an example burner.

As illustrated in the drawing, a burner 70 includes a burner port 71 and a shielding plate 73. And other configurations except the burner port 71 and the shielding plate 73 may be the same as those in the previous example.

The burner port 71 includes an outer port 71*a* and an inner port 71*b*. The outer port 71*a* is formed in a cylindrical shape of which an upper surface is opened, and may include an accommodating portion 711 and a flange portion 712. And a tube insertion hole 711*a* is formed at the accommodating portion 711. And a plate seating portion 711*b* on which the heating element 42 is seated is formed at an upper end of the accommodating portion 711, and an inner port seating portion 711*e* is formed under the plate seating portion 711*b*.

And the inner port 71*b* is further formed inside the outer port 71*a*. The inner port 71*b* is formed so that an upper surface and a lower surface are opened, and a distribution rib 713 is formed at an inner side surface of the inner port 71*b*. The distribution rib 713 includes a first rib 713*a* and a second rib 713*b*, and a shape thereof may be the same as that of the distribution rib 413 in the previous example.

And the inner port 71*b* is formed to have an outer diameter corresponding to an inner diameter of the outer port 71*a*, and also formed to be seated on the inner port seating portion 711*e*. And extension tube holes 714 through which the extension tubes 341 pass may be further formed.

In some implementations, an aligning portion 711*f* which is recessed to correspond to a circumference of the inner port 71*b* and a lower end of the distribution rib 713 may be formed at the outer port 71*a*. Therefore, the inner port 71*b* may be aligned inside the outer port 71*a*, and may be coupled to the outer port 71*a* at an exact location.

The shielding plate 73 may be seated on a shielding plate seating portion 715 formed inside the inner port 71*b*. And a plurality of distribution holes 733 are formed at the shielding plate 73. The plurality of distribution holes 733 may be continuously radially formed at a center portion of a straight portion 732. Therefore, a density of the distribution holes 733 per unit area may be increased from a curved portion 731 toward the straight portion 732, and the mixed gas in the burner port 71 may pass through the distribution holes 733, and may flow toward the heating element 42.

In some implementations, the gas cooker may not be installed at the furniture such as the sink in a built-in method, but may be independently installed at a separate case.

Figure 18:
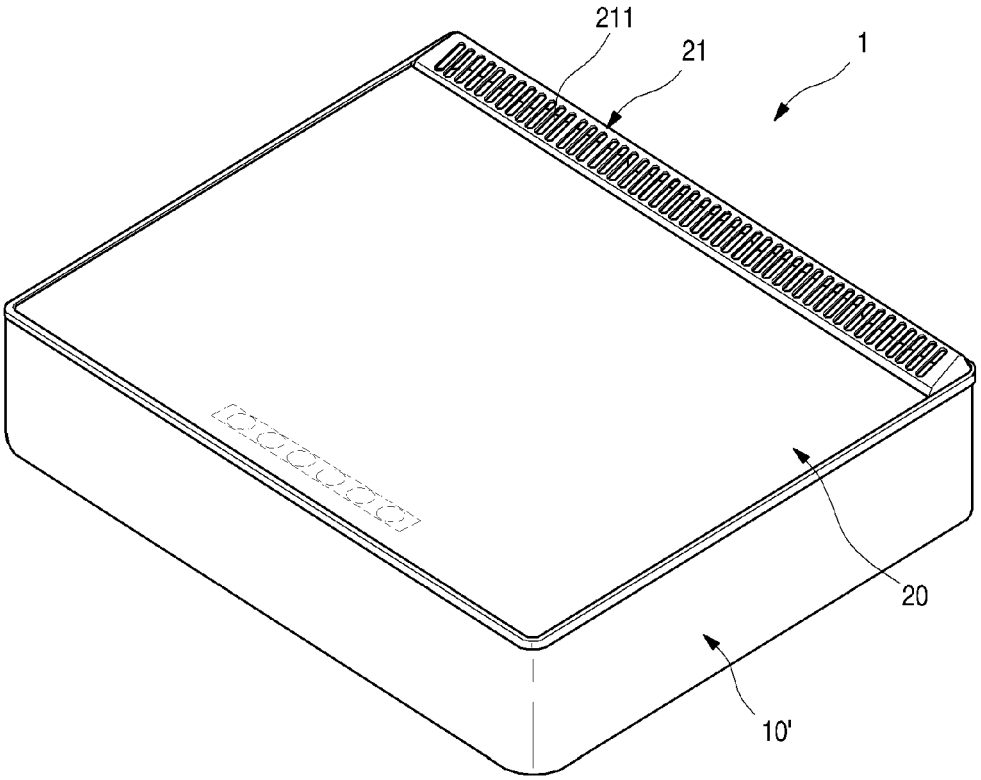
FIG. 18 is a diagram illustrating an example gas cooker.

FIG. 18 illustrates an example gas cooker.

As illustrated in the drawing, a gas cooker 1 includes the same plate 20 and case 10 as those in the previous example, and an internal structure of the case 10 may also be the same.

However, the gas cooker 1 may be formed to be seated on an outer case 10' which forms an exterior while the plate 20 and the case 10 are assembled.

In some implementations, instead of the configuration of the case 10, the plate 20 may be directly installed at the outer case 10', and all of the elements including the burner unit 30 which are disposed in the case 10 may be installed inside the outer case 10'.

What is claimed is:

1. A burner for a gas cooker comprising:

a burner port defining an interior area, the burner port including an opening to the interior area;

one or more tubes that are coupled to the burner port and that are configured to provide mixed gas to the interior area of the burner port;

a plurality of ribs that are configured to guide mixed gas flow provided from the one or more tubes and that are located in the interior area of the burner port;

a heating element that is configured to cover the opening of the burner port and that is heated by gas-generated heat; and a shielding plate that (i) is disposed between the heating element and the plurality of ribs, (ii) is configured to partially cover a portion of the opening of the burner port, and (iii) is configured to spread mixed gas that is provided from the one or more tubes into the interior area of the burner port, wherein the plurality of ribs include:

first ribs that are extended from an outlet port side of the tubes, at least one end of the first ribs being spaced apart from a wall surface that faces the outlet port of the tubes; and second ribs that are disposed at a lateral side of the first ribs and that are extended from the wall surface that faces the outlet port of the tubes toward the outlet port side, wherein the shielding plate is disposed above upper ends of the plurality ribs, and covers a space between the wall surface that faces the one or more tubes and at least one end of the plurality of ribs.

2. The burner of claim 1, wherein a seating portion is formed on an inner wall surface facing the outlet port of the tubes and is formed to protrude toward an inside of the burner port to support an outer circumference of the shielding plate.

3. The burner of claim 1, wherein the shielding plate includes a plurality of holes, wherein mixed gas is configured to pass through the plurality of holes.

4. The burner of claim 3, wherein the interior area of the burner port includes a central area and a peripheral area surrounding the central area, wherein the plurality of holes are more densely distributed in the central area than in the peripheral area.

5. The burner of claim 3, wherein the interior area of the burner port includes a central area and a peripheral area surrounding the central area, wherein the plurality of holes on the shielding plate are radially distributed in the central area.

6. The burner of claim 1, wherein the shielding plate includes:

a curved portion that corresponds to an inner circumference of the burner port, and a straight portion that connects both ends of the curved portion and that extends across the plurality of ribs.

7. The burner of claim 1, wherein the shielding plate is coupled to the upper ends of the plurality of ribs.

8. The burner of claim 1, wherein at least one end of the first ribs divides the outlet port of a first tube of the one or more tubes, the first ribs guiding mixed gas flow that is provided from the first tube.

9. The burner of claim 8, wherein the second ribs are not coupled to the first tube and are configured to change mixed gas flow that is provided from the first tube.

10. The burner of claim 9, wherein the second ribs are coupled to a second tube of the one of more tubes.

11. The burner of claim 1, wherein each of the one or more tubes is, in part, in the interior area of the burner port and the one or more tubes are aligned substantially in parallel.

12. The burner of claim 9, wherein the second ribs are spaced apart from both sides of the first ribs and are extended in parallel with the first ribs.

13. The burner of claim 1, wherein the burner port includes:

an inner port that is configured to receive mixed gas from the one or more tubes and that is coupled to the plurality of ribs, and an outer port that holds the inner port.

14. The burner of claim 1, further comprising:

a spark plug that is located adjacent to the heating element and that is configured to ignite mixed gas provided from the one or more tubes; and an ignition rib that is coupled to the burner port and that is configured to guide mixed gas flow toward the spark plug.

15. A gas cooker, comprising:

a case defining a case interior area, the case including a case opening to the case interior area;

a plate covering, fully or in part, the case opening of the case;

a burner that is located in the interior area of the case and that is configured to provide heat using mixed gas;

a vent that is located at a first position of the case and that is configured to discharge burned gas from the interior area of the case to an exterior area of the case; and an insulating case that is coupled to the burner and that is configured to hold the burner, wherein the burner includes:

a burner port defining an interior area, the burner port including an opening to the interior area, one or more tubes that are coupled to the burner port and that are configured to provide mixed gas to the interior area of the burner port, a burner holder that holds the burner port and that is configured to guide mixed gas flow provided from the one or more tubes toward the vent, a heating element that is configured to cover the opening of the burner port and that is heated by gas-generated heat;

a plurality of ribs that are configured to guide mixed gas flow provided from the one or more tubes and that are located in the interior area of the burner port, and a shielding plate that (i) is disposed between the heating element and the plurality of ribs, (ii) is configured to cover a first portion of the opening of the burner port, and (iii) is configured to spread mixed gas that is provided from the one or more tubes into the interior area of the burner port, wherein the plurality of ribs include:

first ribs that are extended from an outlet port side of the tubes, at least one end of the first ribs being spaced apart from a wall surface that faces the outlet port of the tubes; and second ribs that are disposed at a lateral side of the first ribs and that are extended from the wall surface that faces the outlet port of the tubes toward the outlet port side, wherein the shielding plate is disposed above upper ends of the plurality ribs, and covers a space between the wall surface that faces the one or more tubes and at least one end of the plurality of ribs.

16. The gas cooker of claim 15, further comprising a first member that is coupled to the burner holder and that is configured to delay burned gas flow that flows from the interior area of the burner port toward the vent.

17. The gas cooker of claim 15, further comprising a cooling unit that is coupled to the case and that is configured to generate air flow toward the vent.

18. The gas cooker of claim 17, wherein the burner holder includes a hole that is configured to allow air to flow from the exterior area of the case into the interior area of the case.

19. The gas cooker of claim 15, wherein the heating element is coupled to the burner holder.

20. The gas cooker of claim 15, wherein the shielding plate includes a plurality of holes, wherein mixed gas is configured to pass through the plurality of holes.

* * * * *